United States Patent [19]

Vorwerk

[11] 4,280,706

[45] Jul. 28, 1981

[54] SEAL FOR FLUIDIZING OUTLET

[75] Inventor: Frederick E. Vorwerk, St. Peters, Mo.

[73] Assignee: ACF Industries, Inc., New York, N.Y.

[21] Appl. No.: 104,343

[22] Filed: Dec. 17, 1979

[51] Int. Cl.[3] ..... B61D 7/22; F16J 15/06; F16J 15/40

[52] U.S. Cl. ..... 277/12; 277/27; 277/58; 277/192; 105/282 A; 105/424; 220/81 R; 220/378

[58] Field of Search ..... 220/81 R, 378; 105/247, 105/280, 282 A, 299, 424, 282 P; 277/12, 27, 58, 166, 178, 186, 189, 193, 192, 199, 207 R, 215

[56] References Cited

U.S. PATENT DOCUMENTS

| | | | |
|---|---|---|---|
| 1,251,683 | 1/1918 | Miller et al. | 105/280 |
| 2,360,345 | 10/1944 | Hilkemeier | 277/58 X |
| 3,485,183 | 12/1969 | Floehr | 105/424 X |
| 3,621,793 | 11/1971 | Floehr | 105/282 A |
| 3,807,318 | 4/1974 | Chierici | 105/282 A |
| 3,831,803 | 8/1974 | Hutchison et al. | 220/81 R X |

FOREIGN PATENT DOCUMENTS

| | | | |
|---|---|---|---|
| 723878 | 12/1965 | Canada | 220/378 |
| 2734186 | 2/1979 | Fed. Rep. of Germany | 105/424 |

*Primary Examiner*—Robert S. Ward, Jr.
*Attorney, Agent, or Firm*—Henry W. Cummings

[57] ABSTRACT

A seal is provided between an outlet mounting flange and a hopper mounting flange. The seal extends inboard of the inner hopper wall and includes a projection extending upwardly which engages the hopper wall. The seal further includes a tapered portion which extends inwardly and downwardly from the projection. Thus lading and pressure in the outlet act to urge the projection into engagement with the vertical wall and the tapered portion into engagement with its supporting surface. In one embodiment a void space is located below the projection which is compressed in assembly to create a tight fit of the seal against the hopper wall. In another embodiment an outer flange portion is provided which extends around the inner end of the hopper mounting flange to aid in positioning the seal for assembly. In one application the seal is used in a fluidizing outlet which includes a metal sheet containing at least one opening through which the fluidizing medium passes and a layer of filter material resting thereon to remove impurities in the fluid.

20 Claims, 7 Drawing Figures

Fig. 3

SEAL FOR FLUIDIZING OUTLETCL
BACKGROUND OF THE INVENTION

In U.S. Pat. No. 3,831,803, a seal between a railway hopper and a hopper outlet is disclosed including projections or protuberances which aid in achieving a seal between the hopper and the outlet, and bevelled portions located at the inner ends of the seal which aid in directing lading down the outlet walls.

U.S. Pat. No. 3,807,318 discloses a gravity outlet having a seal in which the lading and pressure in the car urge a lower inner lip into engagement with a gravity gate.

SUMMARY OF THE INVENTION

A seal is provided between an outlet mounting flange and a hopper mounting flange. The seal extends inboard of the inner hopper wall and includes a projection extending upwardly which engages the hopper wall. The seal further includes a tapered portion which extends inwardly and downwardly from the projection. Thus lading and pressure in the outlet act to urge the projection into engagement with the vertical wall and the tapered portion into engagement with its supporting surface. In one embodiment a void space is located below the projection which is compressed in assembly to create a tight fit of the seal against the hopper wall. In another embodiment an outer flange portion is provided which extends around the inner end of the hopper mounting flange to aid in positioning the seal for assembly. In one application the seal is used in a fluidizing outlet which includes a metal sheet containing at least one opening through which the fluidizing medium passes and a layer of filter material resting thereon to remove impurities in the fluid. The ends of the sheet and filter layer are held in place by fasteners extending through the hopper and outlet mounting flanges.

THE DRAWINGS

DESCRIPTION OF PREFERRED EMBODIMENTS

Figures 1, 2, 3, 4, 5, 6, 7:
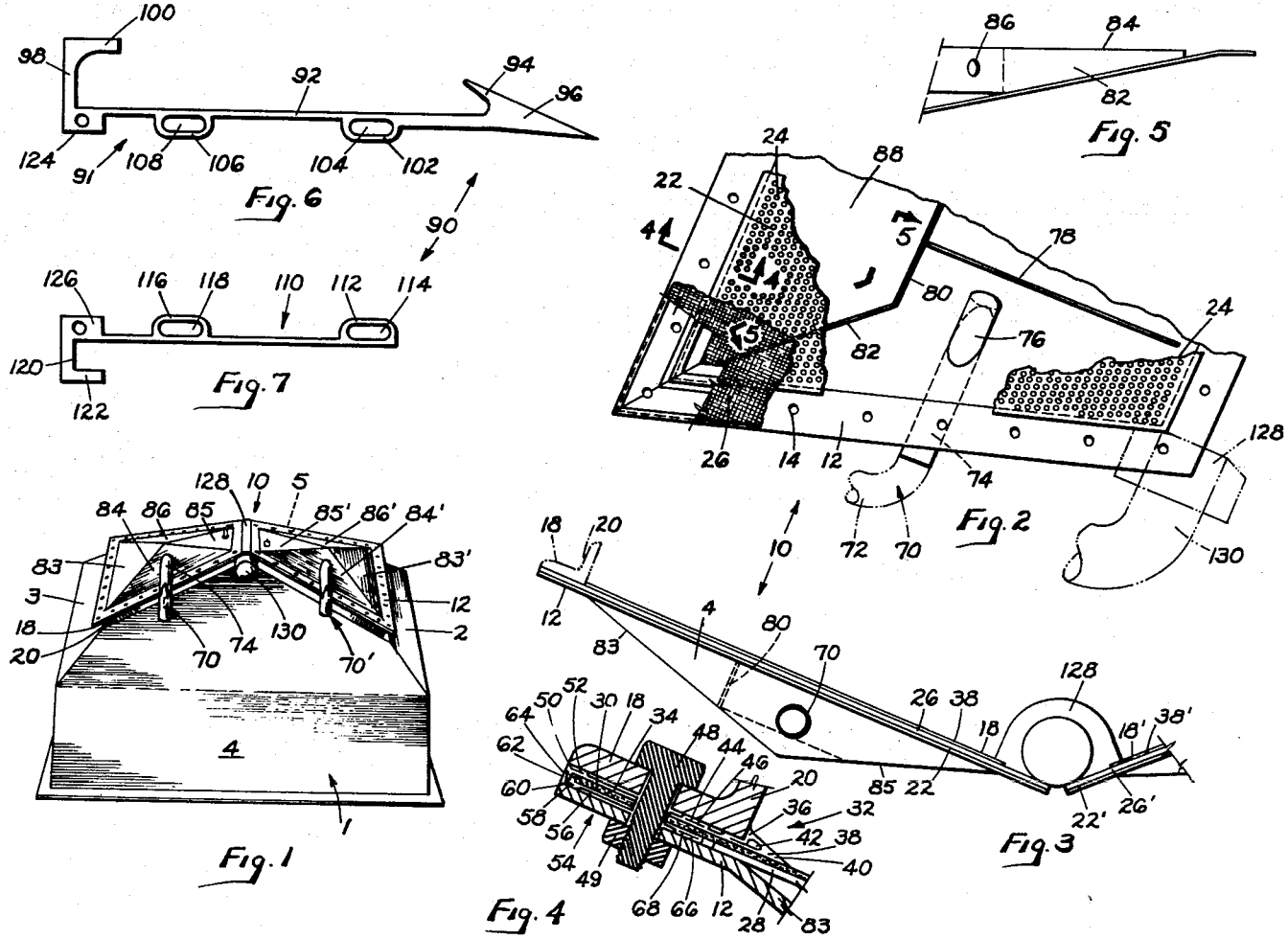
FIG. 1 is a schematic perspective bottom view of the outlet of the present invention mounted upon a hopper.
FIG. 2 is a partial plan view of the outlet of the present invention after the hopper and the outlet have been rotated 180° from the position shown in FIG. 1.
FIG. 3 is a partial side elevation view of FIG. 2.
FIG. 4 is a sectional view looking in the direction of the arrows along the line 4—4 in FIG. 2.
FIG. 5 is a view looking in the direction of the arrows along the line 5—5 in FIG. 2.
FIG. 6 is a detail view of the top member of an alternative seal member.
FIG. 7 is a detail view of the lower member of the seal member illustrated in FIG. 6.

A hopper 1 includes sloping side walls 2 and 3 and end walls 4 and 5. The hopper in upright position is supported by a suitable frame structure (not shown). A fluidizing outlet is indicated in the drawings generally at 10. This outlet includes a mounting flange 12 having openings therein 14 to receive fasteners 48 to hold the outlet in place upon a hopper 1. Hopper 1 includes a mounting flange 18 and a vertical wall portion 20. A metal sheet 22 includes a plurality of openings 24 through which a fluidizing medium passes to fluidize the lading. A filter 26 is located upon the metal sheet.

The metal sheet has an inner end 28 and the filter has an inner end 30 which is located between the outlet flange 12 and a hopper flange 18.

A seal member indicated generally at 32 includes a body portion 34 located upon filter member 30 and below outlet flange 18. The seal includes a vertical projection 36 which engages the hopper wall portion 20. The seal further includes a tapered portion 38 which is tapered downwardly and inwardly from the projection 36 which terminates at 40 above the sheet inner end 28. It will be apparent that fluid pressure in the outlet will tend to urge the projection 36 into engagement with the vertical wall 20 and urge the tapered portion 38 into engagement with the filter inner end 30 to provide a tight seal.

In addition, a void space 42 may be provided located generally below the projection 38 which can be compressed to some extent during assembly to reduce inconsistencies and unevenness in the filter, the metal sheet or the flanges, and to ensure a tight seal between filter 26 and hopper wall 20. In addition, a projection 44 including a hollow portion 46 is located on body portion 34. The purpose of this projection 44 is to allow for discontinuities and unevenness in assembly when a fastener 48 is used to tighten the assembly of the hopper flange portion 12, the filter member 30, the seal 32 and the hopper flange portion 18. In addition, a second projection 50 is conveniently provided at the inner end of the seal, again including an opening 52 which is compressed in assembly as shown in FIG. 4. It is convenient, though not essential, to provide the seal member in two pieces. If this is done, a lower seal member 54 including a body portion 56 is located below filter portion 30 conveniently including a projection 58 having an opening 60 which is compressed in assembly and further including an upwardly extending lug 62. In addition the upper filter member includes a depending lug 64 which abuts lug 62. The lower seal member conveniently includes another projection 66 at its outer end including an opening 68 which is compressed in assembly. A nut 49 holds the assembly together. Metal sheet 28 is conveniently though not essentially located outboard of lower seal member 54.

It is thus apparent that the seal projection 36 and the taper 38 provide an assembly whereby the fluid pressure within the outlet will urge the seal member into sealing engagement with the outlet wall 20 and the tapered portion 38 into engagement with the filter 26. In addition, the projections 44, 50, 58 and 66 allow for discontinuities and unevenness in the abutting flanges 12 and 18 in the steel sheet end 28 and in the end of the filter member 30.

A pipe 70 including a 90° bend 72 is connected to a source (not shown) of fluidizing air. Pipe 70 includes a portion 74 extending horizontally into the outlet. An opening 76 at the inner end distributes the fluid into the outlet below sheet 22. An outlet stiffener 78 extends transversely of the outlet transversely of the car. Another stiffener 80 extends perpendicular to stiffener 78 and includes a generally inclined portion 82. Inclined portion 82 includes an upper surface 84 and an opening 86 (FIG. 5) for fluid to pass through into compartment portion 88. Stiffeners 78, 80 and 82 support the metal sheet and the filter medium in the body portion of the outlet.

As shown in FIG. 1, the outlet includes tapered bottom walls 83, 84, 85 and 86; 83', 84', 85' and 86'. The outlet is constructed in a similar manner on the other side of the outlet above bottom wall 85 including metal sheet 22', filter member 26', outlet wall flange portion 18' and seal portion 38'.

Another embodiment of the seal assembly of the invention is illustrated in FIGS. 6 and 7. In this embodiment the seal assembly 90 includes an upper member 91 having a body portion 92 having a projection 94 at its outer end and a taper 96 as described above. In the unassembled condition the projection 94 extends at an angle of less than 90° with respect to the body portion 92. At the outer end of the body portion 92 a vertical portion 98 is provided which includes an inwardly extending lip 100. The distance between the vertical portion 98 and the projection 94 is such that the outlet flange portion 18 will just fit therebetween. Thus seal portions 98 and 100 are essentially assembly locating members. In addition, void space 42 provided in the embodiment shown in FIG. 4 is not required in this construction, although it may be provided if desired. The vertical projection 94 and taper 96 ensure that the fluid pressure within the outlet will again urge the seal into a sealed condition with respect to the wall 20 and the filter member 30. Discontinuity projection 102 having an opening 104, and a projection 106 having an opening 108 are also conveniently provided.

A lower seal member 110 is further provided including a discontinuity projection 112 having an opening 114 and another discontinuity projection 116 having an opening 118. In this embodiment the lower member 110 is provided with a downwardly extending vertical portion 120 also having an inwardly extending lip 122 sized appropriately to engage the outlet flange inner end to again aid in assembly. A depending lug 124 located on the upper member and an upwardly extending lug 126 located on the lower member are aligned above one another in assembly and are separated by the inner end 30 of filter 26.

In operation, fluidizing air is introduced through pipe 70 into horizontal conduit 74 and into the outlet. The air passes through openings 78*a* and 86 in stiffeners 78 and 80 to reach all parts of the outlet. The air passes through the metal sheet openings 24 and through the filter member 26 to fluidize the lading in the outlet. The lading is removed through an outlet 128 (FIG. 3) and into a product line connected thereto 130 (FIG. 2). From here it is transferred into a container therefor.

What is claimed is:

1. An outlet seal comprising: a seal located between an outlet mounting flange and a hopper mounting flange; said seal extending inboard of an inner hopper wall and including a projection extending upwardly which engages said hopper wall; said seal further including a tapered portion which extends inwardly and downwardly from said projection, whereby lading and pressure in the outlet act to urge the projection into engagement with the vertical wall and said tapered portion into engagement with a supporting surface.

2. An outlet seal according to claim 1 wherein a void space is located below said projection which is compressed in assembly to create a tight fit of the seal against the hopper wall.

3. A hopper outlet according to claim 1 wherein an outer flange portion is provided on said seal which extends around the inner end of said hopper mounting flange to aid in positioning the seal for assembly.

4. An outlet seal according to claim 1 wherein said seal is made in two parts, with one seal part located above the other.

5. An outlet seal according to claim 4 wherein means are provided for interlocking the inner ends of said upper and lower seal members.

6. An outlet seal according to claim 4 wherein said lower seal member includes a flange portion which engages the outer surface of said outlet flange.

7. An outlet seal according to claim 1 including at least one projection having a void space which is compressed in assembly to achieve a good seal.

8. An outlet seal according to claim 4 including at least one projection having a void space which is compressed in assembly to achieve a good seal.

9. A fluidizing outlet comprising: a metal sheet containing at least one opening through which a fluidizing medium passes; a layer of filter material resting on said sheet of steel; the ends of said steel sheet and filter layer having inner ends held in place by a hopper mounting flange and an outlet mounting flange; a seal provided between said outlet mounting flange and said hopper mounting flange located at least upon the inner end of said filter; said seal extending inboard of an inner hopper wall and including a projection extending upwardly which engages said hopper wall; said seal further including a tapered portion which extends inwardly and downwardly from said projection whereby the fluidizing pressure acts to urge the projection into engagement with the vertical wall and tapered end in engagement with the filter medium.

10. A fluidizing outlet according to claim 9 including a void space located below said projection which is compressed in assembly to create a tight fit of the seal against the hopper wall.

11. A fluidizing outlet according to claim 9 wherein said seal includes at least one additional void space which is compresssed in assembly to achieve a good seal.

12. A fluidizing outlet according to claim 9 wherein said seal includes an outer flange portion which extends around the inner end of the hopper mounting flange to aid in positioning the seal for assembly.

13. A fluidizing outlet according to claim 9 wherein said seal is formed in two portions, upper and lower members which surround the filter member.

14. A fluidizing outlet according to claim 13 wherein in assembly said sheet is located inboard of the lower seal member.

15. A fluidizing outlet according to claim 9 wherein a bottom wall is spaced below said metal sheet to define a plenum chamber.

16. A fluidizing outlet according to claim 15 wherein a conduit extends into said plenum chamber to fluidize lading in the hopper.

17. A fluidizing outlet according to claim 16 wherein said hopper is provided with a pneumatic discharge conduit.

18. A fluidizing outlet according to claim 17 wherein at least one stiffener extending upwardly from said bottom wall supports said sheet.

19. A fluidizing outlet according to claim 18 wherein said stiffener includes an opening to provide fluid communication throughout the outlet chamber.

20. A fluidizing outlet according to claim 9 wherein said sheet includes a plurality of openings for air to pass through to fluidize the lading.

* * * * *